United States Patent [19]

Peters et al.

[11] 4,192,271

[45] Mar. 11, 1980

[54] REGULATING APPARATUS FOR A FUEL SUPPLY SYSTEM FOR A MIXTURE-COMPRESSING, EXTERNALLY IGNITED INTERNAL COMBUSTION ENGINE

[75] Inventors: Klaus-Jürgen Peters, Affalterbach; Michael Wissmann, Gerlingen; Peter Schelhas, Stuttgart, all of Fed. Rep. of Germany

[73] Assignee: Robert Bosch GmbH, Stuttgart, Fed. Rep. of Germany

[21] Appl. No.: 905,302

[22] Filed: May 2, 1978

[30] Foreign Application Priority Data

May 14, 1977 [DE] Fed. Rep. of Germany ..... 2721864

[51] Int. Cl.[2] ..... F02M 39/00

[52] U.S. Cl. ..... 123/139 AW; 123/139 ST; 261/44 A; 261/DIG. 74

[58] Field of Search ..... 123/139 AW, 139 ST, 123/140 MC; 261/44 R, 44 A, 50 A, 50 R, 39 D, 39 E, DIG. 74; 236/101 E, 101 C; 251/11

[56] References Cited

U.S. PATENT DOCUMENTS

| | | | |
|---|---|---|---|
| 3,782,349 | 1/1974 | Kamo | 251/11 |
| 3,993,034 | 11/1976 | Passera | 123/140 MC |
| 4,090,486 | 5/1978 | Stump | 123/140 MC |
| 4,105,000 | 8/1978 | Wessel | 123/139 AW |
| 4,122,813 | 10/1978 | Barnert | 123/139 ST |
| 4,131,099 | 12/1978 | Wessel | 123/139 E |

*Primary Examiner*—Ira S. Lazarus
*Assistant Examiner*—Carl Stuart Miller
*Attorney, Agent, or Firm*—Edwin E. Greigg

[57] ABSTRACT

A regulating apparatus is proposed for a fuel supply system for a mixture-compressing, externally ignited internal combustion engine, which serves to enrich the fuel-air mixture furnished to the engine when it is started cold and while it warms up. The regulating apparatus comprises a pressure-regulating valve which sets the fuel pressure, the closing force of which on the movable valve part is influenced by a temperature-dependent element by means of a relay device and a regulating spring coaxially correlated therewith. Accordingly in a predetermined temperature range, the temperature-dependent element and the movable valve part are connected only by the regulating spring.

5 Claims, 5 Drawing Figures

K
KO
15
60
T[°C]

1
2
3
4
5
7
8
9
10
11
24
25
30
31
32
33
34
35
36
58
67
68

REGULATING APPARATUS FOR A FUEL SUPPLY SYSTEM FOR A MIXTURE-COMPRESSING, EXTERNALLY IGNITED INTERNAL COMBUSTION ENGINE

BACKGROUND OF THE INVENTION

The invention relates to a regulating apparatus for a fuel supply system for a mixture-compressing externally ignited internal combustion engine with a pressure-regulating valve, whose movable valve part is influenced from one direction by fuel pressure and a pressure spring and from the other by a temperature-dependent element which effects a temperature-dependent alteration of pressure. A regulating apparatus is already known in which the fuel-air mixture, when the internal combustion engine is started cold and until the motor's operating temperature is reached, is made leaner in a linear relationship by temperature-dependent means. This has the disadvantage that, immediately after the engine is started, very high proportions of noxious ingredients are found in the exhaust.

OBJECT AND SUMMARY OF THE INVENTION

The regulating apparatus according to the invention has the advantage that in adjusting to the fuel volatilization curve after a cold start, in order both to reduce the amount of noxious exhaust gases and to save fuel, the rich fuel-air mixture needed in starting is more quickly leaned before a preset temperature is readied than afterward. This is suitable, since the cylinder walls are prewarmed within a short time after the start, as a result of the ignitions which have just taken place, so that any condensation of fuel on the previously cold cylinder walls is increasingly unlikely; thus, until the engine's operating temperature is reached, a more limited enrichment of the fuel-air mixture is needed for smooth running than would otherwise be necessary.

By means of the measures described in the claims below, advantageous refinements and improvements to the regulating apparatus of the primary claim are made possible.

It is also particularly advantageous that the temperature-dependent element which determines the enrichment of the fuel-air mixture is at first, below a preset temperature, indirectly connected with the movable valve part by means of the regulating spring, and then, above this preset temperature, directly connected by means of the relay device.

The invention will be better understood as well as further objects and advantages thereof become more apparent from the ensuing detailed description of a preferred embodiment of the invention taken in conjunction with the drawings.

DESCRIPTION OF THE PREFERRED EMBODIMENT

Figures 1, 5:
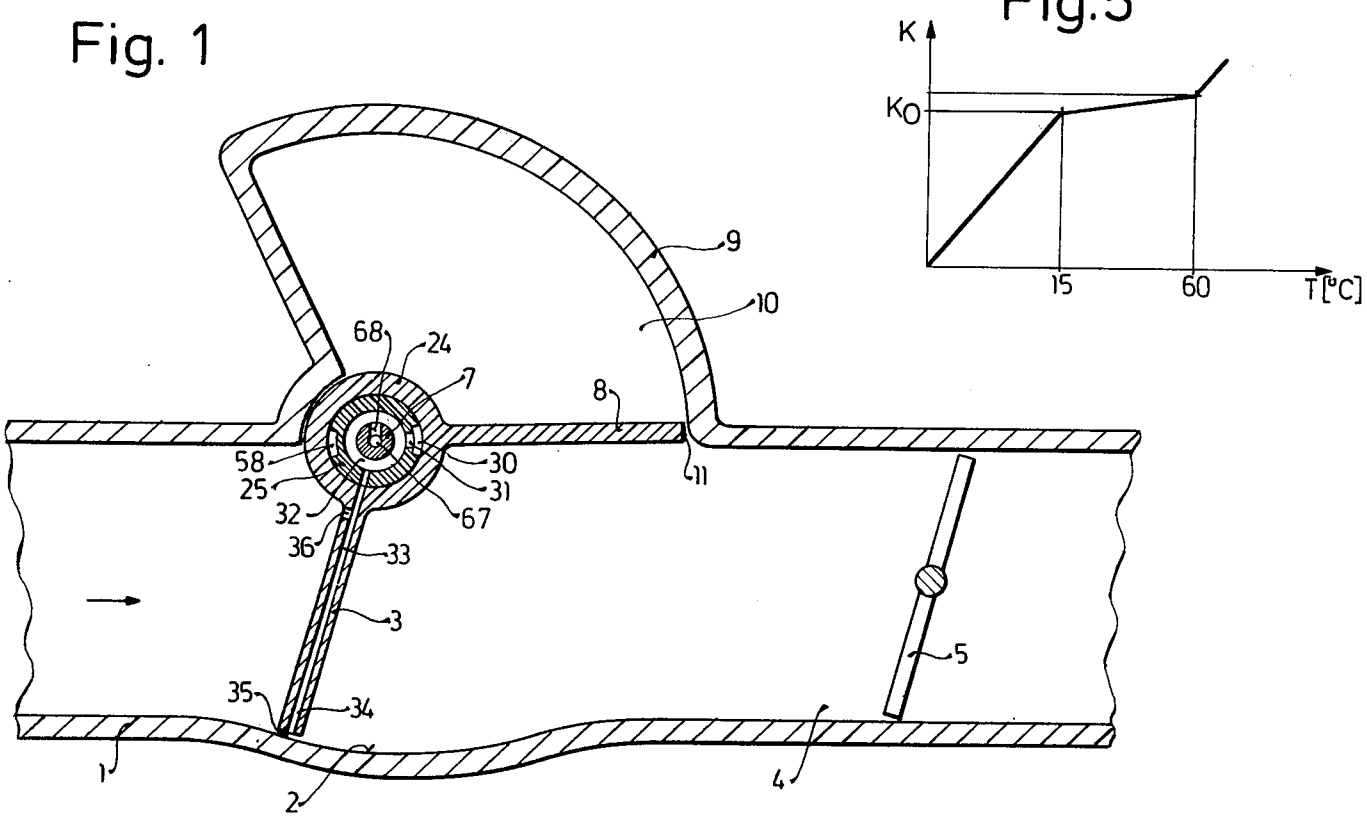
FIG. 1 is a cross-sectional view looking into a short section of a fuel supply line on line I—I of FIG. 2.
FIG. 5 is a diagrammatic view which shows the operation of the temperature-dependent closing force on the regulating apparatus.

In the fuel injection mechanism represented in FIG. 1, the combustion air flows in the direction of the arrow into an air induction line 1, which is provided with a curved section 2 containing a measuring element constructed as a barrier valve 3, and further flows through a section 4 containing an arbitrarily manipulatable throttle valve 5 and on to one or several cylinders (not shown) of an internal combustion engine. The measuring element constructed as the barrier valve 3 moves within the complementally formed section 2 of the air induction line 1 as a nearly linear function of the air quantity flowing through the air induction line in which, for a constant air pressure prevalent upstream of the measuring element 3, the air pressure prevailing between the measuring element and the throttle valve 5 likewise remains constant. The measuring element 3 is pivotal about a fixed bearing axle 7 disposed transversely relative to the air induction line, and it is provided with a damping valve 8. The damping valve 8 can travel into a damping section 9 of the air induction line during an opening movement of the measuring element 3. The chamber 10 formed by the damping valve 8 and the damping section 9 communicates with the air induction line downstream of the measuring element 3 via a small gap 11 that is provided between the extremity of the damping valve 8 and the opposing wall of the damping section 9. It is a result of the incorporation of the damping valve 8 that the induction tube pressure fluctuations evoked by the suction strokes have practically no influence upon the angular positioning of the measuring element 3.

Figure 2:
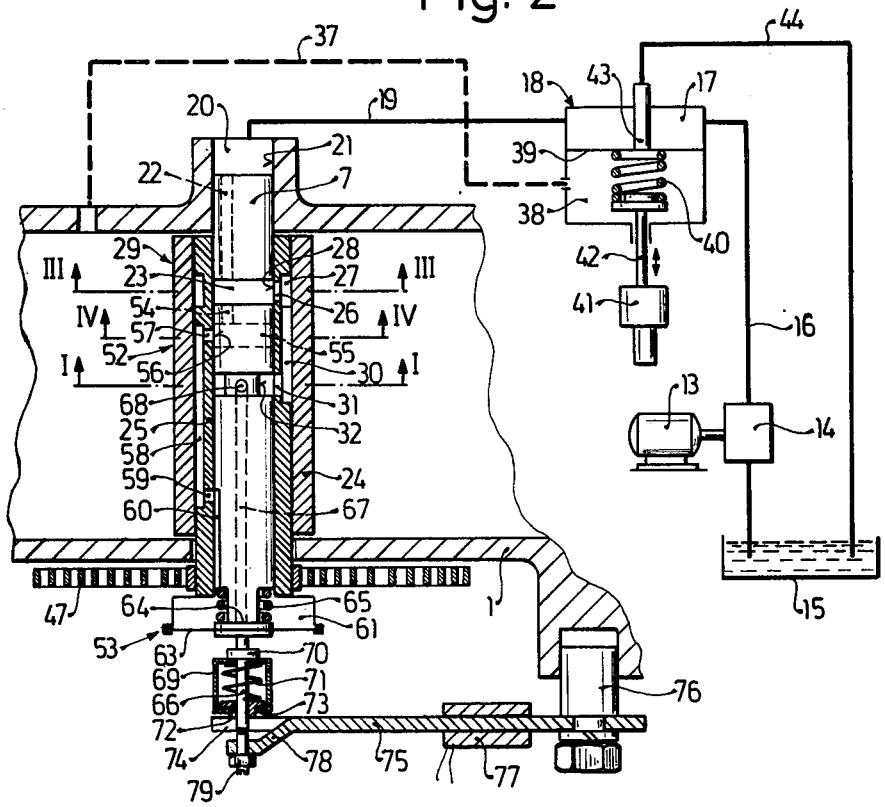
FIG. 2 is a schematic view of the fuel supply system with a regulating arrangement according to the invention.
Figure 3:
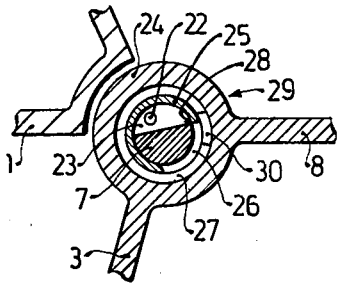
FIG. 3 is a fragmentary cross-sectional view of the fuel supply system along the line III—III of FIG. 2.
Figure 4:
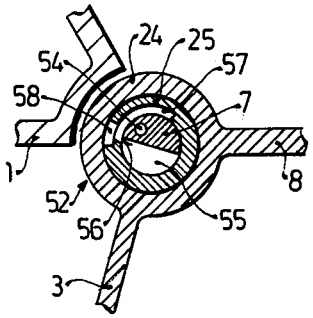
FIG. 4 is another fragmentary cross-sectional view of the fuel supply system along the line IV—IV of FIG. 2.

As depicted in FIG. 2, the supplying of the fuel takes place by means of a fuel pump 14 driven by an electric motor 13, which fuel pump 14 pumps fuel from a fuel container 15 and delivers the same to a chamber 17 of a differential pressure valve 18 via a line 16. From the chamber 17 the fuel travels to a chamber 20 via a line 19, which chamber 20 is formed by the end face of the bearing axle 7 and the guide boring 21 of the bearing axle 7. The chamber 20 communicates with a notch 23 machined into the bearing axle 7, via a boring 22 depicted in FIG. 2 by dashed lines. The measuring element 3 and the damping valve 8 are integrally disposed upon a carrier body 24, which is firmly attached to a sleeve 25 which is rotatably supported around the bearing axle 7. The sleeve 25 incorporates a control slit 26 which leads to an annular groove 27. The control slit 26 cooperates with a control edge 28 (FIG. 3), which is formed by the interface of the notch 23 with the bearing axle 7. The control slit 26 is opened more or less according to the given attitude of the measuring element 3 by means of the control edge 28, so that a proportional fuel quantity can be apportioned relative to the air quantity aspirated by the internal combustion engine. The control edge 28 and the control slit 26 cooperate with a sleeve-like apportioning valve 29 disposed about the bearing axle 7 of the measuring element 3. From the annular groove 27, the apportioned fuel reaches an annular groove 32 of the bearing axle 7 via a notch 30 and an opening 31 in the sleeve 25. The annular groove 32 communicates with a line 33 located in the shaft of the measuring element 3, which line 33 leads via an injection jet 34 to the gap 35 at the face of the measuring element 3, which gap 35 is exposed to the highest air velocity, between the face of the measuring element 3 and the opposing curved wall of the air induction line 2. The line 33 communicates with the induction tube section 1 upstream of the measuring element 3 via an air opening 36 so that the induction tube pressure prevalent upstream of the measuring element prevails downstream of the fuel apportioning location and acts as a counter pressure. The line 33 can, although not shown here, also communicate with several injection jets 34 disposed in the lower surface of the measuring element 3. An injection slit extending nearly over the entire width of the surface of the measuring element 3 can also serve as the injection jet 34. Furthermore, the injection jet 34 could, although it is not shwon here, be supplanted by an injection valve.

The apportionment of the fuel at the sleeve-like apportioning valve 29 takes place at a constant pressure difference. For this reason, a chamber 38 separated from the chamber 17 of the differential pressure valve 18 by a membrane 39 communicates with the induction tube section 1 upstream of the measuring element 3 via an air line 37 represented by a dashed line, so that the same pressure prevails in the chamber 38 as is provided downstream of the control slit 26. The differential pressure valve 18 is urged toward the closed direction by a spring 40 disposed within the chamber 38. The force of the spring 40 can be changed depending on the operational size of the internal combustion engine. To this end, for example, an electromagnet 41 that includes a shaft 42 and a seat 42*a* for spring 40 can be employed, or an auxiliary force whose strength depends on the operational size of the engine can bear directly on the membrane 39. The force of the magnet, for example, can be changed in response to a signal from an oxygen sensor mounted in the exhaust line of the internal combustion engine.

The differential pressure valve 18 is embodied as a flat seat valve having a membrane 39 as its movable valve member and a fixed valve seat 43 over which fuel can flow into a return line 44 terminating in the fuel container 15. The differential pressure valve serves at the same time as a system pressure control valve.

The measuring element 3 is displaced in opposition to the force of a helical spring 47, one of the ends of which is coupled to the sleeve 25, whereas the other end is connected with a stop on the air induction tube. The basic setting of the metering valve 29 may be changed by rotating the bearing axle.

As shown in FIG. 1, the line 33 communicates with an air opening 36, which opens into the air induction line upstream of the measuring element 3.

The application of the induction tube pressure prevalent upstream of the measuring element 3 via the air opening 36, in its function as a counter pressure at the apportioning location, has the further advantages, aside from the advantage of preconditioning the apportioned fuel with the air, that, on the one hand, an open injection jet can be utilized, and, on the other hand, that the regulation of a constant differential pressure at the apportioning location can be simplified.

The enrichment of the fuel-air mixture during the cold start and the warm-up period is accomplished as follows: During the warming up phase of the engine, a supplementary amount of fuel is measured at a fuel valve 52 and this amount depends on the altitude of the measuring element 3. Also, this fuel is carried by means of a temperature-dependent pressure-regulating valve 53 attached downstream from the fuel valve 52 over the injection jet 34, and is finally injected into the air induction line together with the amount of fuel measured at the apportioning valve 29. The fuel valve 52 is advantageously placed in the fixed bearing axle 7. For this purpose, the notch 23 of the apportioning valve 29 communicates by means of a boring 54 with a groove 55 provided in the fixed bearing axle 7, which results in the formation of a control edge 56 at the interface of the fixed bearing axle 7 and the groove 55. The control edge 56 cooperates with a control slit 57 provided in the sleeve 25 and this opens into a vertical groove 58 of the sleeve 25. The control slit 57 can be opened more or less widely by means of the control edge 56, depending on the altitude of the measuring element 3. From the vertical groove 58, the amount of fuel measured at the fuel valve 52 flows through a boring 59' in the sleeve 25 and through a vertical groove 60 in the fixed bearing axle 7 into a valve chamber 61 of the temperature-dependent pressure-regulating valve 53. The pressure-regulating valve 53 is embodied as a flat seat valve having a membrane 63 as its movable valve member and this cooperates with a projection of the fixed bearing axle 7 that is embodied as a fixed valve seat 64 in the valve chamber 61. In this chamber, the fuel pressure downstream from the fuel valve 62 prevails, and a pressure spring 65 presses the membrane in the opening direction of the pressure-regulating valve 53.

The membrane 63 may be pressed in the closing direction of the valve by means of a relay pin 66. A guide bearing 69 in the form of a capsule is coaxially affixed to the relay pin 66 and supported on one side by a stop 70 that is carried by the relay pin 66. The capsule member 69 is disposed about the relay pin 65 with the perforated end thereof abutting the stop 70 and the other apertured end supporting a perforated plate that rests against a plate member 72. The spring 71 positioned within the capsule 69 maintains the elements in proper assembly as shown in the drawing. The end of the relay pin 66 which is disposed toward the membrane 63 projects through the plate 72 as shown. A bimetallic arm 75 is affixed to a mounting stud 76. The free end 74 of the arm rests against the plate 72. During the warming-up phase, the bimetallic arm expands in the direction of the membrane 63. To augment this action, an electrical heating element 77 that is mounted onto the bimetallic arm forms a circuit with the vehicle's battery, which is closed by the ignition and firing switch immediately after the motor vehicle engine starts. Thus the bimetallic arm, augmented during the warming-up period by the heating element 77, expands further in the direction of the membrane 63 and increases the closing force exerted thereon. The free end 74 of the bimetallic arm 75 is cut to form two strips, one of which is bent into a tab 78 and angled away from the membrane 63. The end of the relay pin 66 which is nearest the membrane 63 projects into the hollow space created by bending down part of the free end of the bimetallic arm. An activating pin 79 that is disposed in the tab 78 is axially adjustable and lies coaxial with the relay pin 66. The fuel quantity flowing over the fixed valve seat 64 of the pressure-regulating valve 53 flows through an axial boring 67 in the fixed bearing axle 7 and through a radial boring 68 (FIG. 1) into the annular groove 32 of the fixed bearing axle 7. During the warming-up phase of the motor vehicle engine, that fuel is injected, together with the fuel measured at the apportioning valve 29, through the injection jet 34 into the gap 35 between the lower surface of the measuring element 3 and the walls of the air induction line 2.

The method of operation of the fuel injection mechanism is as follows: When the internal combustion engine is running, fuel is aspirated from the fuel container 15 by the fuel pump 14 driven by the electric motor 13, and is delivered to the apportioning valve 29 via the line 16. The internal combustion engine simultaneously aspirates air via the air induction line 1, by means of which aspirated air a certain deflection from the position at rest is imparted to the measuring element 3. Depending on the amount of deflection, the control slit 26 opposite the control edge 28 opens more or less widely. The direct control of the apportioning valve by the measuring element 3 produces a constant relationship between the quantity of induced air and the quantity of apportioned fuel. The apportioning takes place at a pressure differential which is kept constant by means of the differential pressure valve 18, while the adjustment necessary for various operational conditions of the internal combustion engine may be made by changing the spring force of the spring 40 and thereby changing the pressure differential. The injection of the measured amount of fuel is accomplished through the medium of the injection jet 34 which takes place at the lower surface of the measuring element 3 into the gap 35 between the lower surface of the measuring element 3 and the curved wall of section 2, that is, at the point where the air stream flows the fastest, in order to achieve the most homogeneous possible fuel-air mixture. The contour of the curved wall of section 2 opposite to the lower surface of the measuring element can be adjusted to the desired fuel-air mixture.

When the internal combustion engine is started at temperatures below the engine's operating range of 60° to 80° C., a richer fuel-air mixture is desirable, to insure a positive start and smooth running, than that which is needed after the engine's operational temperature is reached. To enrich the fuel during starting and warming up, an additional amount of fuel is apportioned at the fuel valve 52 according to the altitude of the measuring element 3. This additional fuel flows, together with the amount of fuel apportioned by the apportioning valve 29, around the temperature-dependent pressure-regulating valve 53 and through the injection jet 34 into the air induction line. In this way, fuel enrichment can be accomplished without producing a systematic higher pressure within the fuel supply system during the warming-up period. The enrichment of the fuel-air mixture during the cold start and warming-up period of the internal combustion engine is accomplished by reducing the closing force exerted on the pressure-regulating valve 53 and the closing force exerted on the membrane 63 by the bimetallic arm 75 is variably reduced according to the temperature. This temperature-dependent variation of the closing force exerted on the membrane 63 takes place as follows: With starting temperatures under about 15° C., the plate 72 which supports spring 71 touches the stop 73, which prestresses the regulating spring 71 with a force $K_o$ (FIG. 5). The free end of the bimetallic arm 75 touches the plate 72, which projects out beyond the stop 73 in the direction of the bimetallic arm and pulls the membrane 63 in a closing direction by means of the regulating spring 71 that is attached to the projection 70 of the relay pin. At this point the activating pin 79 and relay pin 66 are not yet operational.

At a temperature of approximately 15° C. the force of the bimetallic arm 75 becomes greater than the initial stress $K_o$ of the regulating spring 71, so that this spring 71 is increasingly compressed, until at a temperature of about 60° to 80° C. (depending on the operating temperature of the internal combustion engine) the adjustable activating pin 79 comes into contact with the relay pin 66 and increases the closing force K exerted on the membrane 63 in direct relationship to the sharply climbing characteristic temperature curve of the bimetal selected.

FIG. 5 is a diagram showing the effect of the closing force K on the membrane 63 in relationship to the temperature T. At lower temperatures under about 15° C. a sharper force pressure/temperature gradient is required. This is accomplished as long as the initial stress $K_o$ of regulating spring 71 is not reached and the closing force K is determined only by the force/temperature relatiohship of the bimetallic arm 75. When the initial stress $K_o$ of the spring is exceeded at about 15° C., the regulating spring 71 is compressed by the bimetallic arm 75, which produces a flatter characteristic curve for both the regulating spring and the bimetallic arm. The warming-up period should be ended above about 60° to 80° C., depending on the particular internal combustion engine, that is, the apportionment of fuel at the fuel valve 52 should be prevented by closing the pressure-regulating valve 53. This is accomplished as follows: above approximately 60° to 80° C., the activating pin 79 connected to the tab 78 comes into contact with the relay pin 66, so that the pressure-regulating valve, because of the sharper bimetallic curve, is quickly closed.

FIG. 5 depicts an approximation of the fuel-thinning curve, given as two straight lines, when additional force is applied. This is an approximation of the static situation when the internal combustion engine is started. The adjustment after the engine is started is largely governed by the heat-absorbing and heat-conducting capacity of the bimetallic arm.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A regulating apparatus for a fuel supply system for a mixture-compressing externally ignited internal combustion engine with a pressure-regulating valve, whose movable valve member is influenced from one direction by fuel pressure and a pressure spring and from the other by a temperature-dependent element which effects a temperature-dependent alteration of pressure, further wherein said temperature-dependent element and said movable valve member cooperate with a relay pin, a regulating spring means arranged to encompass said relay pin, means supporting said regulating spring means, said last-named means being associated with said temperature-dependent element and wherein said temperature-dependent element is connected with said movable valve member below a predetermined temperature indirectly by means of said regulating spring means and above said predetermined temperature also directly by means of said relay pin.

2. A regulating apparatus as claimed in claim 1, wherein said regulating spring is positioned in a capsule member which engages a stop affixed to said relay pin.

3. A regulating apparatus as claimed in claim 2, wherein said temperature-dependent element includes a bimetallic arm heated by an electrical heating element.

4. A regulating apparatus as claimed in claim 3, wherein said bimetallic arm includes a tab having an activating pin vertically aligned with said relay pin.

5. A regulating apparatus as claimed in claim 4, wherein said activating pin engages said relay pin at temperatures above the operating temperature of the engine.

* * * * *